US005302302A

United States Patent [19]

Shelley et al.

[11] Patent Number: 5,302,302

[45] Date of Patent: Apr. 12, 1994

[54] HOLSTER FOR CYLINDRICAL ARTICLES, SUCH AS AEROSOL CANS AND THE LIKE

[76] Inventors: Robert O. Shelley, 1706 Linden Ave., Baltimore, Md. 21217; Glenn C. Shelley, 1160 White Sands Dr., Lusby, Md. 20657

[21] Appl. No.: 908,476

[22] Filed: Jul. 6, 1992

[51] Int. Cl.[5] ..... B65D 25/14

[52] U.S. Cl. ..... 224/148; 224/196; 224/245

[58] Field of Search ..... 224/196, 148, 224–226, 224/242, 245, 270, 904, 914

[56] References Cited

U.S. PATENT DOCUMENTS

| | | | |
|---|---|---|---|
| 2,617,105 | 11/1952 | Backman | 224/148 X |
| 3,445,046 | 5/1969 | Wilson | 224/148 |
| 4,496,088 | 1/1985 | Tuthill | 224/904 |
| 4,620,426 | 11/1986 | Pitchford et al. | 224/148 X |
| 4,955,518 | 9/1970 | Parsons et al. | 224/914 |

*Primary Examiner*—Renee S. Luebke
*Attorney, Agent, or Firm*—Leonard Bloom

[57] ABSTRACT

A holster is disclosed for holding an aerosol can or the like intended to be carried on the body of a person. The holster includes a sleeve supported on the body of the person, such that the sleeve is oriented generally vertically. The sleeve has a top open end and a bottom end. The sleeve is tapered downwardly from the top open end of the sleeve to the bottom end thereof. In this manner, the sleeve has an inner diameter at the top open end thereof that is greater than the outer diameter of the can, and the sleeve has an inner diameter near the bottom end thereof that is less than the diameter of the can. Such an arrangement permits the can to be dropped into the top open end of the sleeve, such that it will be frictionally gripped within the sleeve above the bottom end thereof.

15 Claims, 7 Drawing Sheets

HOLSTER FOR CYLINDRICAL ARTICLES, SUCH AS AEROSOL CANS AND THE LIKE

FIELD OF THE INVENTION

The present invention relates to holsters for holding and securing aerosol cans and other cylindrical cans and articles on the body of a person.

BACKGROUND OF THE INVENTION

Automobile mechanics, touch-up repairmen, and the like often utilize aerosol cans during the course of their work for reasons as varied as providing lubricants, silicones, paints and the like. However, the use of such aerosol cans present problems with holding and maintaining the aerosol cans and the like in close proximity to the worker, so that these cans can be easily located and readily made available for use. In this regard, it is common during the work process for such cans to be misplaced or otherwise lost on the job site.

In addition, bottles and other reservoirs, which have a shape that is similar to that of aerosol cans, are also now employed to store therein under pressure butane, propane or other similar combustible gas for use as a fuel for a torch. The product is referred to as a "plumber's torch". In such cases, the torch includes a head which is fitted onto the standard bottle of gas. The head has a flint switch for the ignition of the pressurized gas within the bottle, and the flame is projected forwardly of the nozzle. Since the nozzle can become somewhat hot, problems are also encountered in insuring the proper orientation of these torches, so that the hot nozzle will not come into contact with the body or the clothes of the user.

Besides aerosol cans and plumbers' torches, similar problems are encountered with caulking tubes, tubes containing "liquid nails", and cans of glues and adhesives.

Running around on a job site—trying to find a misplaced aerosol can or a caulking tube—wastes a lot of time and is inefficient. Besides, the plumbers' torches (for example) are fairly expensive, retailing for around $70.00, so that a torch that is lost or "walks off the job" is a substantial monetary loss.

Accordingly, it can be seen that there remains a need for a holster or similar device which may hold and maintain cylindrical articles, such as aerosol cans and the like, in close proximity to the worker, so that the can may be easily located and readily made available for use. There further remains a need for such a holster which can help to insure the proper orientation of such cans and the like, so that no harm will come to the worker or the clothes which the worker is wearing.

SUMMARY OF THE INVENTION

It is an object of the present invention to provide a holster for holding and maintaining a cylindrical article, such as an aerosol can and the like, in close proximity to the worker, so that the worker may locate and readily use the can.

It is another object of the present invention to provide such a holster which may be attached to the body or clothes of the worker, so that the can is readily accessible to the worker as he or she moves about on the job site.

It is still another object of the present invention to provide such a holster which insures the proper orientation of such cans and the like, so that harm will not come to the worker or the clothes which the worker is wearing.

It is yet another object of the present invention to provide a holster which will prevent an aerosol can or the like from inadvertently marring the finish of an automobile or other equipment.

It is a further object of the present invention to provide such a holster which permits the cans and the like to be easily removed therefrom with the use of only one hand.

It is a still further object of the present invention to provide such a holster which is simple, inexpensive to make, and nonobtrusive and convenient for the worker to wear and use.

In accordance with the teachings of the present invention, a holster is disclosed for a cylindrical article, such as an aerosol can or the like, intended to be carried on the body of a person. The holster includes a sleeve, and means are provided for supporting the sleeve on the body of the person, such that the sleeve is oriented generally vertically. The sleeve includes a top open end and a bottom end, which, preferably, is provided with a shelf. The sleeve is tapered downwardly from the top open end of the sleeve towards the bottom end. In this manner, the sleeve has an inner diameter which is greater than the outer diameter of the can at the top of the sleeve, and which is less than the diameter of the can towards the bottom of the sleeve, so that a means is defined for retaining the can within the sleeve and preventing the can from falling out of the sleeve even if the sleeve is tilted or inverted. As a result, the can may be dropped into the top open end of the sleeve, and the can will be frictionally gripped within the sleeve.

In a preferred embodiment, the sleeve has a longitudinal axis and a lower portion provided with at least one blind slot running substantially parallel to the longitudinal axis of the sleeve. The blind slot communicates with the bottom end of the sleeve. In this manner, insertion of the person's finger through the bottom open end of the sleeve and into the blind slot is permitted to facilitate lifting the can out of the sleeve.

In another preferred embodiment, the top portion of the sleeve has a recess formed therein so as to extend below the top open end of the sleeve. With the provision of this recess, when the can is received within the sleeve, any nozzle thereon is received in the recessed portion. In this manner, the can is oriented into a given circumferential position relative to the holster and the person's body. This is useful for the plumber's torch.

The sleeve may be supported on the person's body by a belt, clip or any other suitable means.

Viewed in another aspect, the present invention provides a holster for a can, tube or other cylindrical article intended to be carried on the body of a person. The holster includes a sleeve, and means are provided for supporting the sleeve on the body of the person, such that the sleeve is oriented generally vertically. The sleeve has a top open portion and a lower portion, so that the can may be dropped into the top open portion of the sleeve; and means are provided within the sleeve for maintaining the can within the sleeve and preventing the can from slipping out of the sleeve even if the sleeve is tilted or inverted. Means are further provided, preferably within the lower portion of the sleeve, to facilitate at least a partial lifting of the can out of the sleeve. The top portion of the can may then be grasped by the person's hand and lifted completely out of the holster, thereby facilitating a one-handed operation for either right-handed or left-handed persons, respectively.

Preferably, the can is cylindrical and has a longitudinal axis and further has an outer diameter. The sleeve is tapered downwardly from its top open portion towards its lower portion, such that the top open portion of the sleeve is greater than the outer diameter of the can, and such that the lower portion of the sleeve is smaller than the outer diameter of the can. As a result, the can is frictionally gripped within the holster, and this frictional engagement provides the means for maintaining the can within the sleeve.

In a preferred embodiment, the sleeve has at least one slot formed therein and running substantially parallel to the longitudinal axis of the cylindrical can, thereby enabling the person's finger to be inserted into the slot to lift the can out of the sleeve. This provides the means within the lower portion of the sleeve to facilitate a lifting of the can out of the sleeve.

These and other objects and advantages of the present invention will become readily apparent from a reading of the following description, when taken in conjunction with the enclosed drawings.

DESCRIPTION OF PREFERRED EMBODIMENTS

Figure 1:
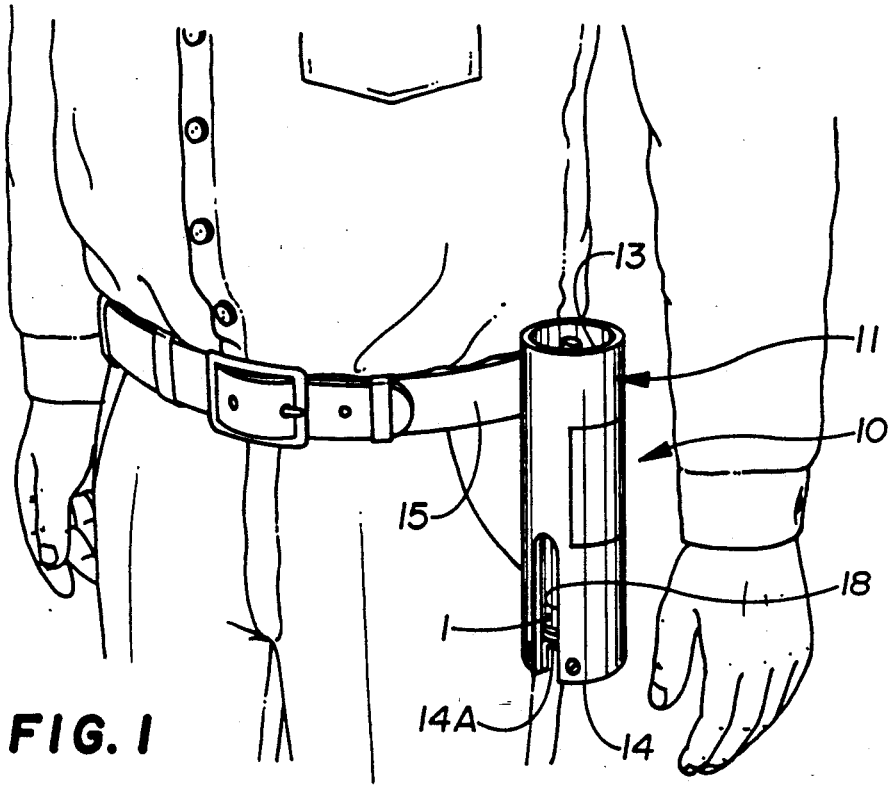
FIG. 1 is a perspective view of the holster of the present invention in use for holding and maintaining an aerosol can or other cylindrical article on the body of the worker, wherein the worker may easily locate and readily use the can.

Referring to the drawings, the holster 10 of the present invention is designed especially for holding an aerosol can 1 or the like on the body of the person. As will be readily evident to those of ordinary skill in the art, the holster of the present invention will be useful with any can, tube or article (and not just aerosol cans) that is cylindrical and has an outside diameter. Such cans include caulking tubes, glue and adhesive tubes, polishes for furniture, and the like. The aerosol cans, especially, are uniform and have a substantially standard outer diameter.

The holster 10 includes a sleeve 11 and a means 12 for supporting the sleeve 11 on the body of the person, such that the sleeve 11 is oriented generally vertically when worn on the body of a person (as best seen in FIG. 1).

Figure 2:
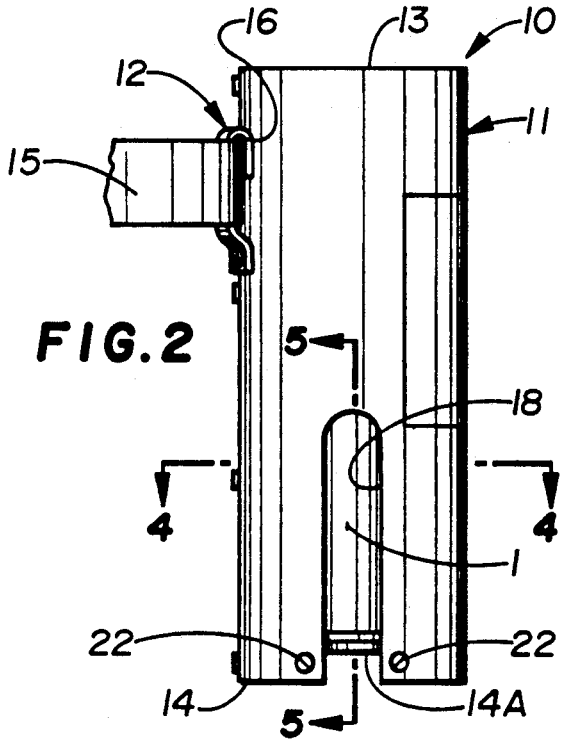
FIG. 2 is a left side elevational view of the sleeve of the holster of the present invention.
Figure 3:
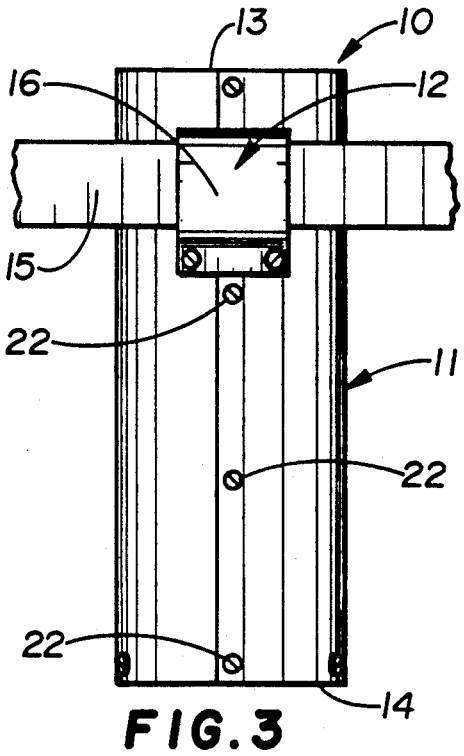
FIG. 3 is a rear view of the sleeve of the holster of the present invention, further showing a means for supporting the sleeve on the person's body.
Figure 4:
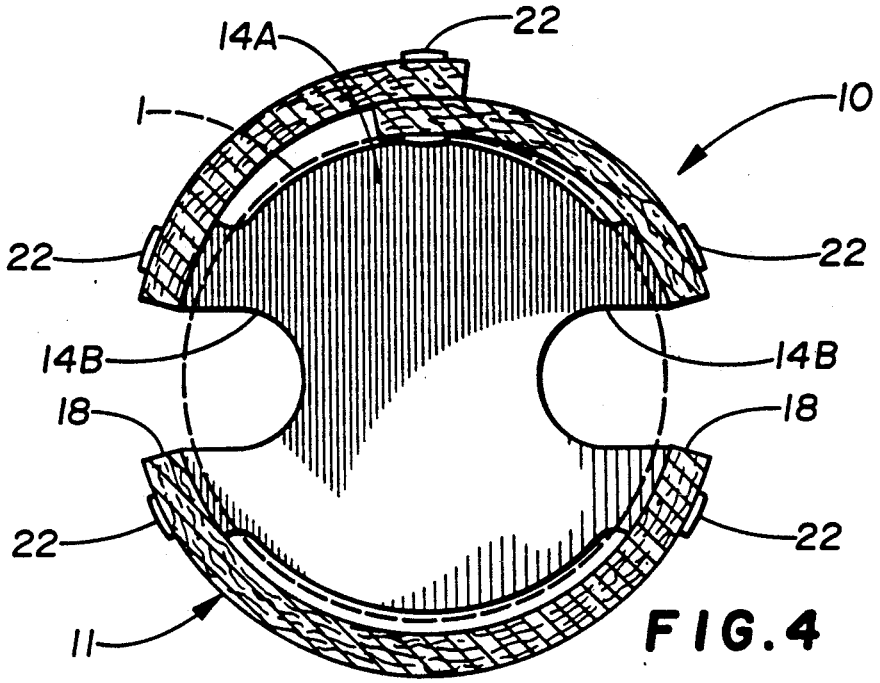
FIG. 4 is a cross-sectioned view of the sleeve taken along lines 4—4 of FIG. 2, and drawn to an enlarged scale.

With reference to FIGS. 2 and 3, the preferred means 12 for supporting the sleeve 11 on the body of a person includes a belt 15 (which is equipped with a buckle, clasp or the like for securing the belt 15 in place on the person's body). In this regard, the belt 15 may be a conventional belt or a heavy duty belt such as commonly utilized in conjunction with tool belts. The belt 15 is suitably joined to the sleeve 11, such that the belt 15 secures and supports the sleeve 11 on the person's body. Preferably, such securing is effected by the sleeve 11 having a loop 16 formed thereon or therein through which the belt 15 is removably disposed. However, it should be clearly understood that other suitable means, such as riveting the belt 15 directly to the sleeve 11, may alternatively be utilized.

It will be appreciated, of course, that any suitable means (such as a clip) may be employed for mounting the holster 10 onto the clothing of a person's body.

Figure 5:
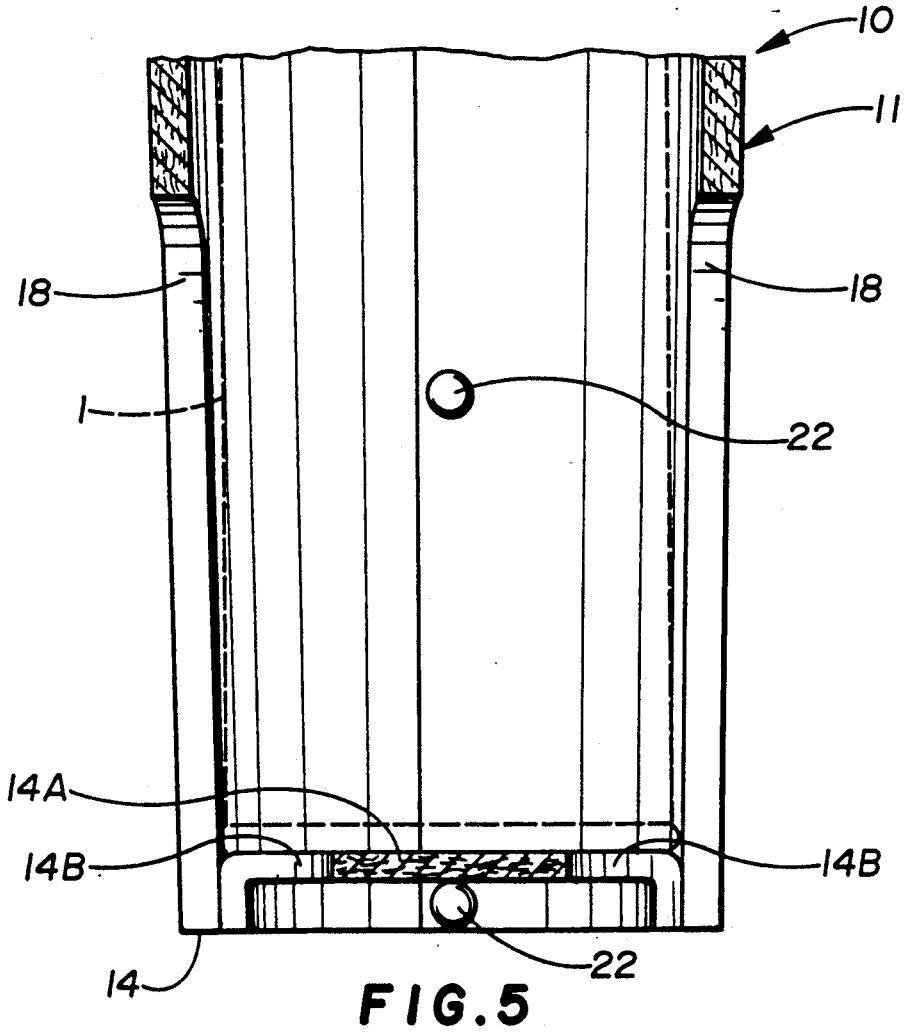
FIG. 5 is a partial cross-section view of the sleeve taken along lines 5—5 of FIG. 2, and drawn to an enlarged scale.
Figure 6:
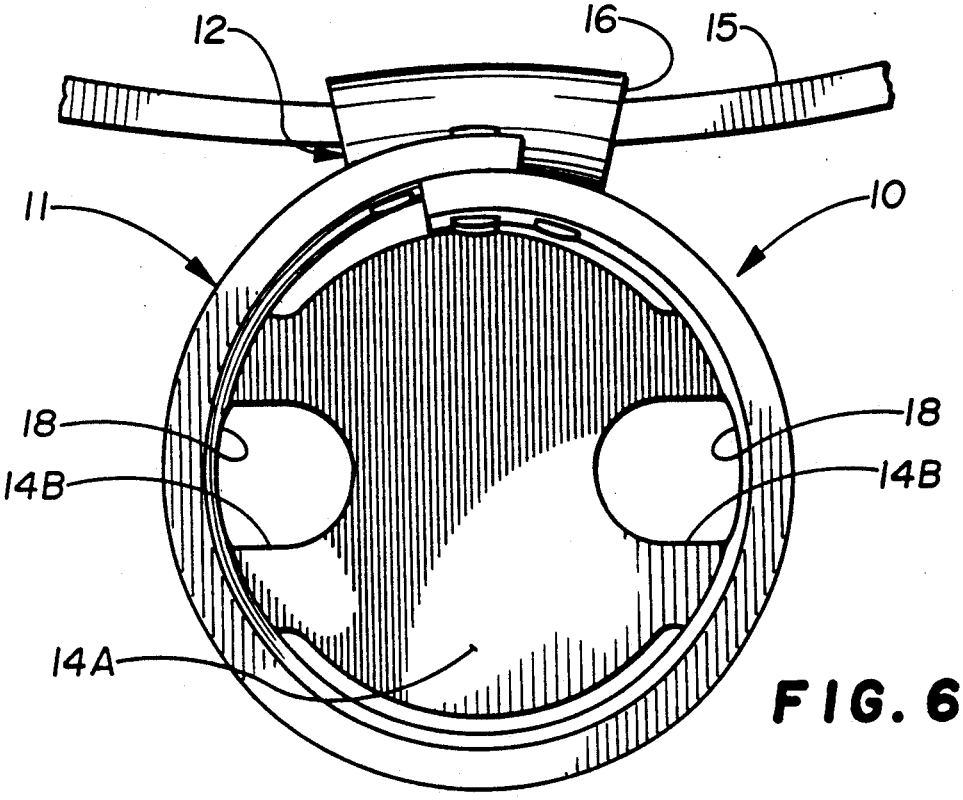
FIG. 6 is a top plan view of the holster of the present invention.

With reference to FIGS. 2 and 3, the sleeve 11 has a pair of ends, including a top open end 13 and a bottom end 14. The bottom end 14 may be either open, or it may be closed by a shelf or end wall 14A that is riveted or otherwise suitably secured to the sleeve 11. The sleeve 11 is further shaped, so as to be tapered downwardly from the top open end 13 towards the bottom end 14, as best seen in FIG. 5.

Formed as described above, the sleeve 11 has an inner diameter which is greater than the outer diameter of the can 1 at the top of the sleeve 11 (including the top end 13 thereof). Furthermore, towards the bottom (including the bottom open end thereof) the sleeve 11 has an inner diameter that is less than the outer diameter of the can 1. In this manner, the can 1 may be dropped into the top open end 13 of the sleeve 11 where it will proceed downwardly under the force of gravity until it either becomes frictionally gripped within the sleeve 11 or comes into contact with the end wall 14A.

The tapered form and the sizing of the sleeve 11 to provide a frictional grip thereby defines a means for retaining the can within the sleeve 11 and a means for preventing the can 1 from falling out of the sleeve 11, even if the sleeve is tilted or inverted. Such a feature is especially important where the bottom end 14 of the sleeve 11 is open.

It is noted herein that when the can 1 is received in the sleeve 11, the top portion of the can 1 may be received either above or below the top open end 13 of the sleeve 11. However, in this regard, it is noted that when the top portion of the can 1 is below the top open end 13 of the sleeve 11, then the body and clothes of the worker will be shielded so that they can not come in contact with the nozzle on the can. Nor will the can inadvertently mar the finish of a car, furniture or other equipment.

An advantage of the holster 10 of the present invention is that can 1 disposed therein may be easily removed therefrom with a simple one-handed operation. To remove the can 1 from the sleeve 11 of the holster 10 of the present invention, all that is needed is for a person to insert a finger through a cut-out 14B formed in the bottom 14 of the sleeve 11 and to push upwardly against the bottom of the can 1 in order to dislodge the can 1 from the frictional grip of the sleeve 11. Continued upward pushing of the can 1 raises the can 1 to a level where the person may then grip the top of the can 1 (with either the same or another hand) for total removal thereof from the sleeve 11 (as best seen in FIGS. 7 and 8).

To provide for easier and more efficient removal of the can 1 from the sleeve 11, the holster 10 is further formed so that the lower portion of the sleeve 11 has a blind slot 18 formed therein that runs substantially parallel to the longitudinal axis of the sleeve 11. This blind slot 18 communicates with either the cut-out 14B formed in the bottom open end 14 of the sleeve 11 (or with the bottom 14 itself, if the bottom 14 is open). Preferably, two such blind slots 18 are formed in the sleeve 11, and these slots 18 are substantially diametrically opposite to each other.

Referring to FIGS. 7, 8, 12 and 13, provision of the blind slots 18 is seen to facilitate the removal of the can 1 from the sleeve 11 by enabling a person to insert his or her finger through the cut-outs 14B or the bottom open end 14 of the sleeve 11 and into one of the blind slots 18 in order to push upwardly against the bottom of the can 1 in the directions of the arrows to upwardly push the can 1 upwardly out of the sleeve 11. The height of the slots 18 facilitates the raising of the can 1 (tube or other cylindrical article) to a height wherein the top of the can 1 is above the top open end 13 of the sleeve 11. In that position, the person may then grip the top of the can 1 with either the same hand in a one-handed operation (FIGS. 7 and 8) or with his or her other free hand (FIGS. 12 and 13) for completely removing the can 1 from the sleeve 11.

Figure 7:
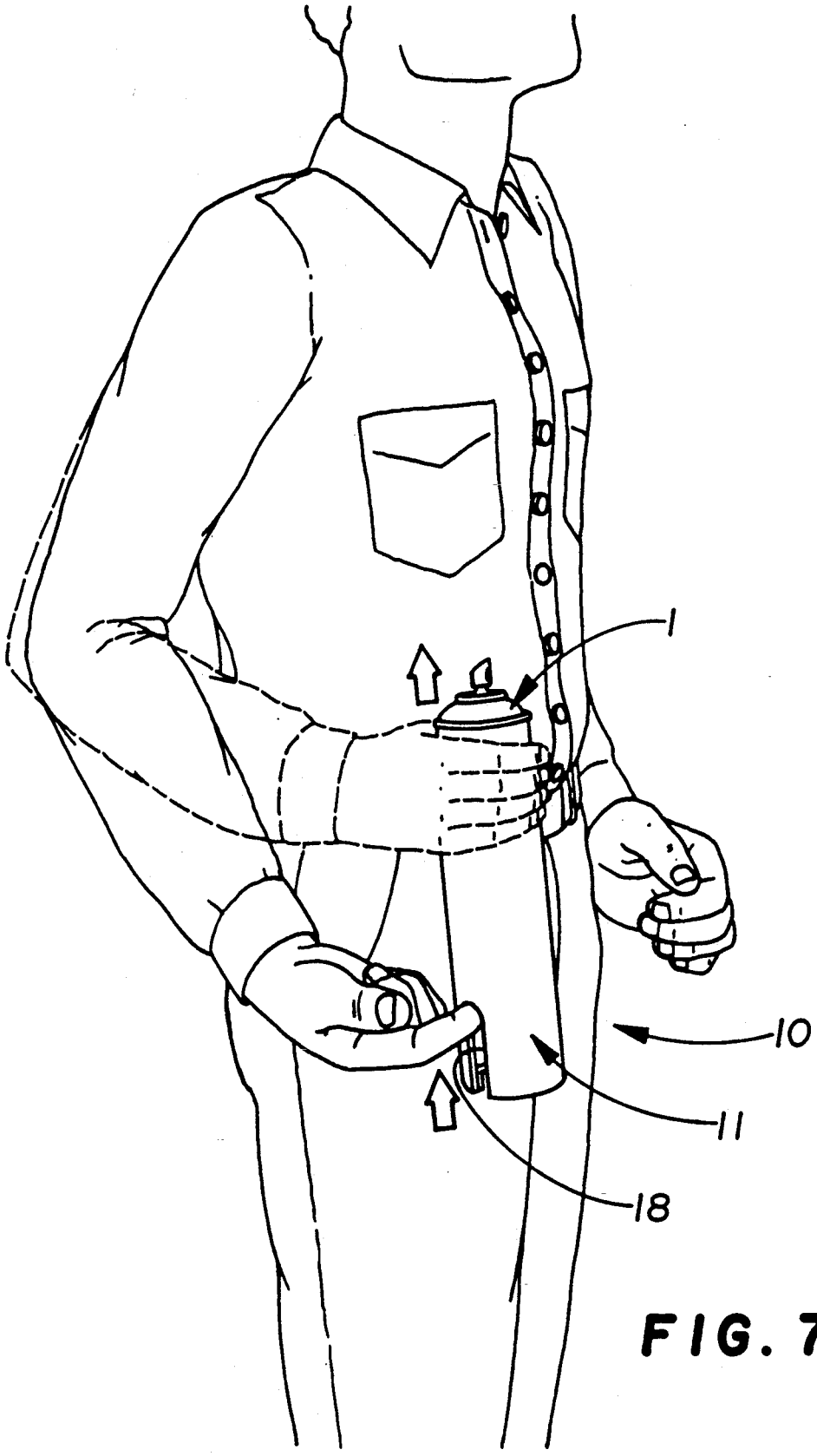
FIGS. 7 and 8 illustrate the one-handed removal of the aerosol can of FIG. 1 from the holster of the present invention by left-handed and right-handed persons, respectively.
Figure 8:
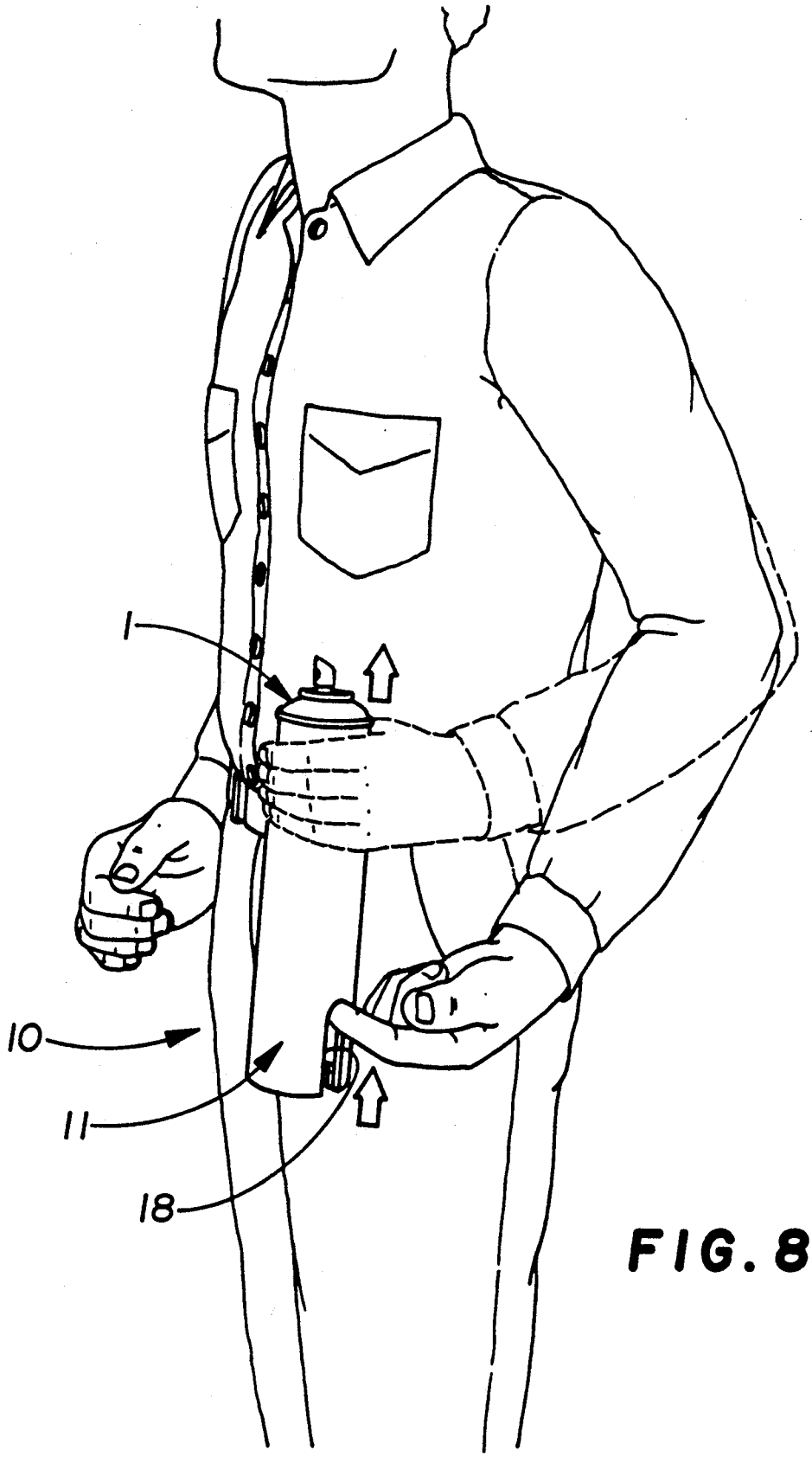

It is noted herein that provision of two diametrically opposed slots 18 (and the communicating cut-outs 14B) facilitates the use of the holster 10 by both right-handed as well as left-handed individuals by, as is seen in FIGS. 7 and 8, permitting the individual to choose which hand to utilize to push on the can 1 and to grip and pull on the can 1.

Referring to FIGS. 9–13, another preferred embodiment of the holster 20 of the present invention is illustrated. In this embodiment, the holster 20 is especially adapted for the purpose of holding a plumber's torch 2 having an extended nozzle 3 and a standard gas can or bottle 4. With the exception of the additional feature discussed below, the holster 20 of FIGS. 9–13 is the same in construction as the holster 10 discussed above with reference to FIGS. 1–8. Accordingly, like numerals will designate like elements.

Figure 9:
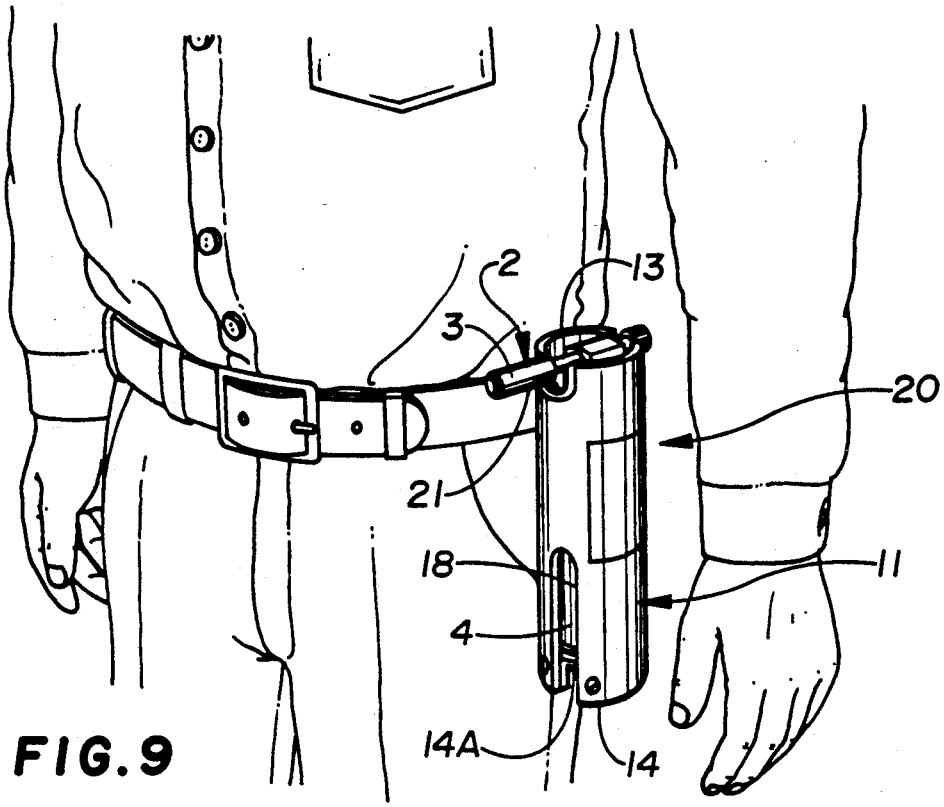
FIG. 9 is a perspective view of the holster of the present invention in use for holding and maintaining a plumber's torch in a given circumferential position relative to the holster on the body of the worker, wherein the worker may easily locate and readily use the torch, and wherein the body and clothes of the worker will not come into contact with the nozzle portion of the torch.
Figure 10:
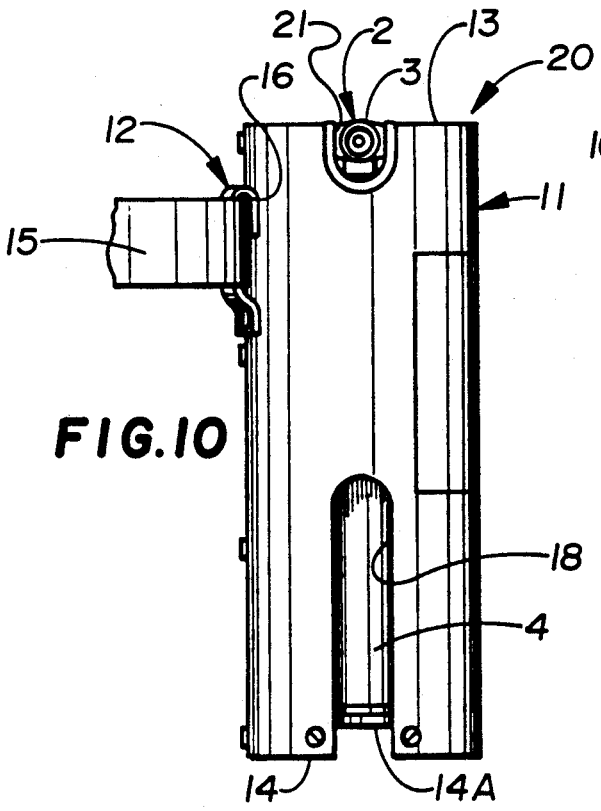
FIG. 10 is a left side elevational view of the sleeve of the holster of FIG. 9.
Figure 11:
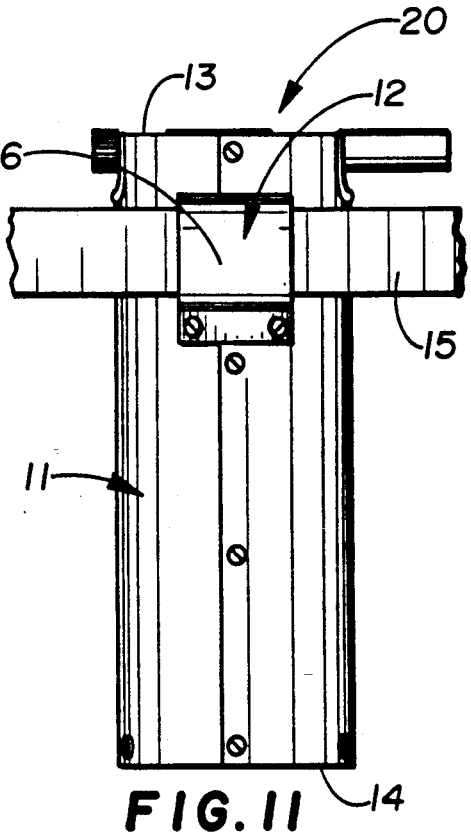
FIG. 11 is a rear view of the sleeve of the holster of FIG. 9.
Figure 12:
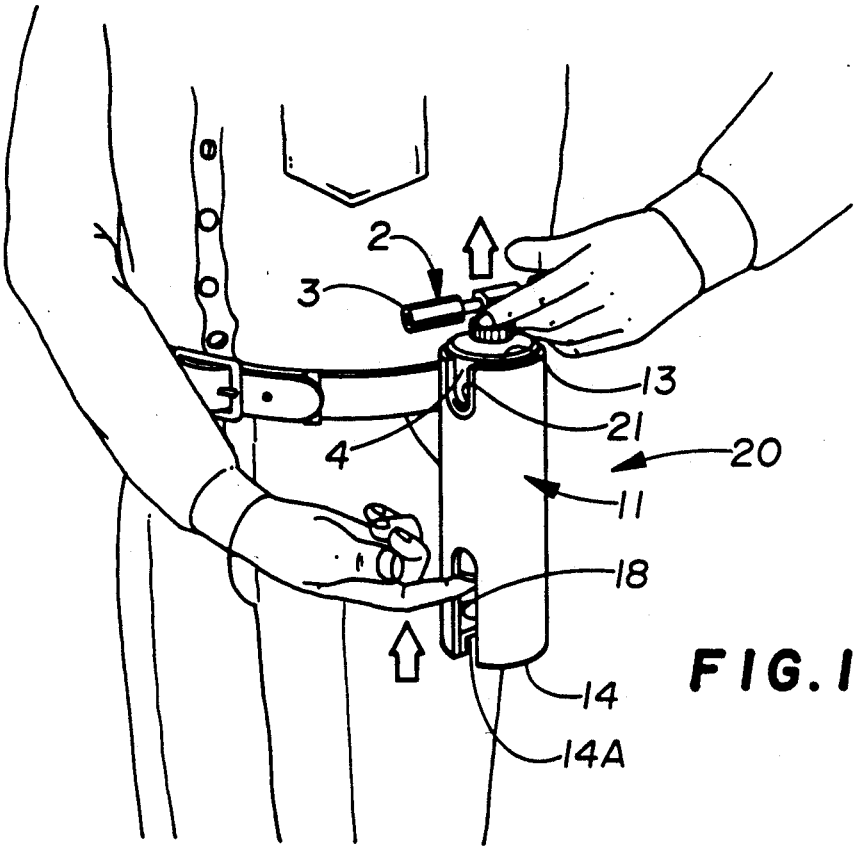
FIGS. 12 and 13 illustrate the removal of the plumber's torch of FIG. 9 from the holster by left-handed and right-handed persons, respectively.
Figure 13:
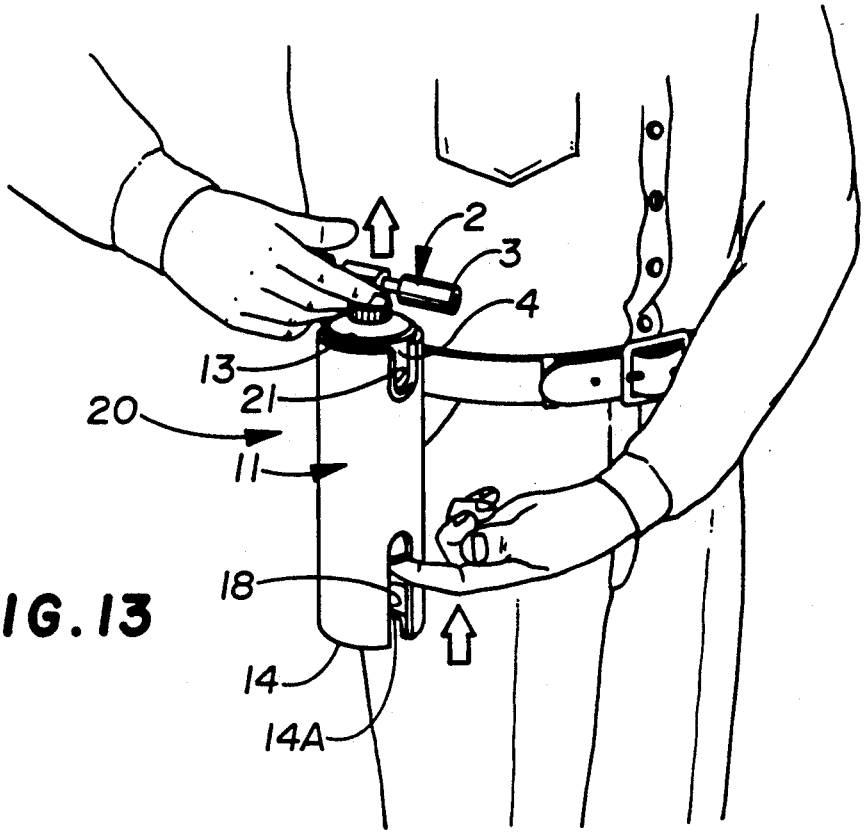

The sleeve 11 is seen having at least one recess 21 formed in the top portion of the sleeve 11, so as to extend below the top open end 13 of the sleeve 11. Preferably (and like slots 18) two such recesses 21 are formed in the top open end 13 of the sleeve 11, and these recesses 21 are diametrically opposed to one another. These recesses 21 are further formed so as to be in communication with the top open end 13 of the sleeve 11. In this manner, when the bottle 4 of the plumber's torch 2 is received within the sleeve 11, the nozzle 3 thereon (and the igniter) may be received in the recesses 21 (as shown in FIGS. 9–11).

It is noted that the recesses 21 permit the torch 2 to be easily oriented into a given circumferential position relative to the holster 20 and the person's body. This is especially important where a plumber's torch is involved in that the nozzle 3 of the torch 2 is often hot and thus should be oriented out of contact with either the clothes or the body of the user.

With reference to FIGS. 12 and 13, once again it is noted that the shape and the features of the holster 2 facilitates the use of the holster 20 by both right-handed as well as left-handed individuals.

With reference again to FIG. 4, the holster 10 (as well as the holster 20 for the plumber's torch 2) are made of leather which is wrapped or formed into a cylindrical sleeve 11 and is retained by a plurality of rivets 22. In lieu of rivets 22, stitching or glue may be employed, if desired. While leather has been used for the preferred embodiment, the holsters may be made of any suitable material.

Figure 14:
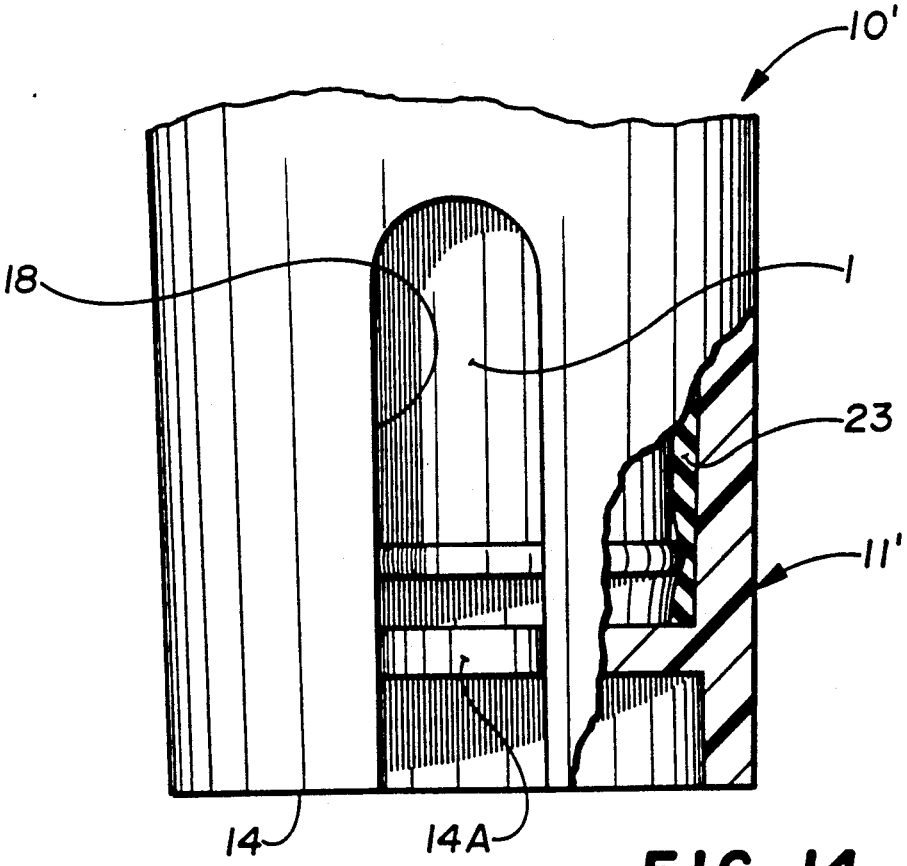
FIG. 14 is a view of a fragmentary lower portion of a modified holster, the view being partially in elevation and partially in section, and showing a molded plastic internally-tapered sleeve provided with a rubber liner.

In FIG. 14, the interally-tapered holster 10[1] has been molded from a suitable plastic material and, preferably, has been provided with a rubber liner 23.

Obviously, many modifications may be made without departing from the basic spirit of the present invention. For example, any cylindrical article may be retained in the holster of the present invention. Thus, the cylindrical article may be a tube of caulking compound or even a confection or icing used by a pastry chef, as well as a plumber's torch or aerosol paint can. Accordingly, it will be appreciated by those skilled in the art that within the scope of the appended claims, the invention may be practiced other than has been specifically described herein.

What is claimed is:

1. A holster for an aerosol can intended to be carried on a body of a person, wherein the can is cylindrical and has an outer diameter, the holster comprising a sleeve, means for supporting the sleeve on the body of the person, such that the sleeve is oriented generally vertically, the sleeve having a pair of ends including a top open end and a bottom end, and the sleeve being tapered downwardly from the top open end of the sleeve towards the bottom end thereof, such that the sleeve has an inner diameter which is greater than the outer diameter of the can at the top of the sleeve, and which is less than the diameter of the can towards the bottom of the sleeve, so that the can may be dropped into the top open end of the sleeve, and the can will be frictionally gripped within the sleeve above the bottom end of the sleeve, the sleeve further comprising access means to the can from the bottom end of the sleeve to enable removal of the can from the open top end of the sleeve without reaching into said open top end.

2. A holster for an aerosol can intended to be carried on a body of a person, wherein the can is cylindrical and has an outer diameter, the holster comprising a sleeve, means for supporting the sleeve on the body of the person, such that the sleeve is oriented generally vertically, the sleeve having a pair of ends including a top open end and a bottom end, and the sleeve being tapered downwardly from the top open end of the sleeve towards the bottom end thereof, such that the sleeve has an inner diameter which is greater than the outer diameter of the can at the top of the sleeve, and which is less than the diameter of the can towards the bottom of the sleeve, so that the can may be dropped into the top open end of the sleeve, and the can will be frictionally gripped within the sleeve, wherein the can has a top portion the bottom of the sleeve having an opening therein, and wherein when the can is received within the sleeve, the top portion of the can is recessed below the top open end of the sleeve, and wherein the person may insert a finger through the opening in the bottom end of the sleeve to lift the can out of the sleeve.

3. The holster of claim 2, wherein the sleeve has a longitudinal axis and further has a lower portion provided with a blind slot running substantially parallel to the longitudinal axis of the sleeve, and the blind slot communicating with the bottom open end of the sleeve, thereby enabling insertion of the person's finger through the bottom open end of the sleeve and into the blind slot to facilitate lifting of the can out of the sleeve.

4. The holster of claim 3, wherein the sleeve has two blind slots formed therein and diametrically opposite to each other, such that the sleeve is adapted for either right handed or left handed persons.

5. A holster for an aerosol can to be carried on a body of a person, comprising a sleeve, means for supporting the sleeve on the person's body, the sleeve being oriented generally vertically and having a longitudinal axis and further having a pair of open ends including a top open end and a bottom open end, such that the can may be slipped through the top open end of the sleeve, means for retaining the can within the sleeve and preventing the can from falling out of the sleeve, and the sleeve having a lower portion provided with a slot running substantially parallel to the longitudinal axis of the sleeve and communicating with the bottom open end of the sleeve, thereby enabling insertion of the person's finger through the bottom open end of the sleeve and into the slot, and thereby facilitating lifting the can out of the sleeve.

6. A holster for an aerosol can to be carried on a body of a person, the holster comprising: a sleeve; means for supporting the sleeve on the person's body; the sleeve being oriented generally vertically and having a longitudinal axis, the sleeve further having a top open end and a bottom end, such that the can may be slipped through the top open end of the sleeve; means for retaining the can within the sleeve and preventing the can from falling out of the sleeve; the sleeve having a lower portion provided with a slot running substantially parallel to the longitudinal axis of the sleeve, thereby enabling insertion of the person's finger through the slot to lift the can out of the sleeve, whereby lifting of the can out of the sleeve is facilitated; the top portion of the sleeve having a recess formed therein so as to extend below the top open end of the sleeve, such that when the can is received within the sleeve any nozzle thereon is received in the recessed portion, whereby the can is oriented into a given circumferential position relative to the holster and the person's body.

7. The holster of claim 6, wherein the means for supporting the sleeve on the person's body includes: a belt for being received and secured about the person's body, the belt being joined to the sleeve, such that the belt secures and supports the sleeve, whereby the sleeve is supported on the person's body.

8. The holster of claim 7, wherein the sleeve includes a loop formed thereon and wherein the belt is removably disposed extending through the loop, whereby the belt is joined to the sleeve, such that the belt secures and supports the sleeve on the person's body.

9. The holster of claim 6, wherein the means for supporting the sleeve on the person's body includes: the sleeve having a loop formed thereon for being looped to the belt or clothing on the person's body, such that the sleeve is secured and supported on the person's body.

10. The holster of claim 6, wherein the can has an outer diameter, and wherein the means for retaining the can within the sleeve and preventing the can from falling out of the sleeve includes: the sleeve being tapered downwardly from the top open end of the sleeve towards the bottom end thereof, such that at the top of the sleeve, the sleeve has an inner diameter which is greater than the outer diameter of the can and which is less than the diameter of the can towards the bottom of the sleeve, so that the can may be dropped in the top open end of the sleeve, and such that the can will be frictionally gripped within the sleeve.

11. A holster for an aerosol can having an outer diameter to be carried on a body of a person, the holster comprising: a sleeve including a loop formed thereon; a belt for being received and secured about the person's body, the belt being removably disposed extending through the loop on the sleeve, whereby the belt is joined to the sleeve, such that the belt secures and supports the sleeve on the person's body; the sleeve being oriented generally vertically and having a longitudinal axis, the sleeve further having a top open end and a bottom end, such that the can may be slipped through the top open end of the sleeve; the sleeve being tapered downwardly from the top open end of the sleeve towards the bottom end thereof, such that at the top of the sleeve, the sleeve has an inner diameter which is greater than the outer diameter of the can and at the bottom of the sleeves the sleeve has an inner diameter which is less than the diameter of the can, so that the can may be dropped into the top open end of the sleeve, and such that the can will be frictionally gripped within the sleeve, thereby retaining the can within the sleeve and preventing the can from falling out of the sleeve; the sleeve having a lower portion provided with a blind slot running substantially parallel to the longitudinal axis of the sleeve, thereby enabling insertion of the person's finger through the slot to lift the can out of the sleeve, whereby lifting of the can out of the sleeve is facilitated; the top portion of the sleeve having a recess formed therein so as to extend below the top open end of the sleeve, such that when the can is received within the sleeve any nozzle thereon is received in the recessed portion, whereby the can is oriented into a given circumferential position relative to the holster and the person's body.

12. The holster of claim 11, wherein the sleeve has two blind slots formed therein and diametrically opposite to each other, such that the sleeve is adapted for either right handed or left handed persons.

13. The holster of claim 11, wherein the sleeve has a plurality of blind slots formed therein for further facilitating lifting of the can out of the sleeve.

14. The holster of claim 11, wherein the top portion of the sleeve has two recesses formed therein and diametrically opposite to each other, such that when the can is received within the sleeve any nozzle thereon is received in one of the recessed portions, whereby the can is oriented into a given circumferential position relative to the holster and the person's body, such that the sleeve is adapted for either right handed or left handed persons.

15. A holster for a can, tube or other cylindrical article, the can including a top portion and being intended to be carried on a body of a person, the holster comprising a sleeve, means for supporting the sleeve on the body of the person such that the sleeve is oriented generally vertically, the sleeve having a top open portion and a lower portion, so that the can may be dropped into the top open portion of the sleeve, means within the sleeve for maintaining the can within the sleeve and preventing the can from slipping out of the sleeve even if the sleeve is tilted or inverted, and means within the lower portion of the sleeve to facilitate a lifting of the can at least partially out of the sleeve, such that the top portion of the can may be grasped by the person's hand and lifted completely out of the holster, thereby facilitating a one-handed operation for either right-handed or left-handed persons, wherein the means within the lower portion of the sleeve to facilitate a lifting of the can out of the sleeve comprises the sleeve having at least one slot formed therein and running substantially parallel to the longitudinal axis of the cylindrical can, thereby enabling the person's finger to be inserted into the slot to lift the can out of the sleeve.

* * * * *